US006673236B2

(12) United States Patent
Stanciulescu et al.

(10) Patent No.: US 6,673,236 B2
(45) Date of Patent: Jan. 6, 2004

(54) METHOD FOR THE PRODUCTION OF HYDROCARBON FUELS WITH ULTRA-LOW SULFUR CONTENT

(75) Inventors: Maria Stanciulescu, Orleans (CA); Michio Ikura, Kanata (CA)

(73) Assignee: Her Majesty the Queen in Right of Canada, as represented by the Minister of Natural Resources, Ottawa (CA)

( * ) Notice: Subject to any disclaimer, the term of this patent is extended or adjusted under 35 U.S.C. 154(b) by 10 days.

(21) Appl. No.: 09/940,485

(22) Filed: Aug. 29, 2001

(65) Prior Publication Data

US 2003/0075483 A1 Apr. 24, 2003

(51) Int. Cl.[7] ..... C10G 27/00

(52) U.S. Cl. ..... 208/208 R; 208/213; 208/232; 208/231; 208/240; 208/249; 208/146; 208/189

(58) Field of Search ..... 208/208 R, 213, 208/232, 231, 240, 249, 196, 189

(56) References Cited

U.S. PATENT DOCUMENTS 3,816,301 A 6/1974 Sorgenti
3,847,798 A 11/1974 Yoo
3,945,914 A 3/1976 Yoo et al.
3,970,545 A 7/1976 Yoo et al.
4,051,014 A 9/1977 Masologites
5,114,434 A 5/1992 Praulus et al.
5,171,728 A * 12/1992 Sakurai et al. ..... 502/178
6,160,193 A 12/2000 Gore
6,171,478 B1 1/2001 Cabrera et al.

OTHER PUBLICATIONS

Hydrocarbon Chemistry, Grorge A. Olah, 1995.*

* cited by examiner

*Primary Examiner*—Walter D. Griffin
*Assistant Examiner*—James Arnold, Jr.

(57) ABSTRACT

The present invention provides a method for producing hydrocarbon fuels with ultra-low levels of sulfur. The method involves catalytic oxidation of the sulfurous compounds within the hydrocarbon fuel, followed by extraction of the oxidized (and polarized) sulfurous compounds using a polar solvent. The present invention teaches the involvement of ethanol during catalytic oxidation. In this way, the oxidation catalyst has a dual-role in the oxidation process: firstly the catalyst directly oxidizes the sulfurous compounds, and secondly the oxidation catalyst converts of a small portion of the alcohol to the corresponding peroxy acid, which also helps to drive the oxidation process.

8 Claims, 4 Drawing Sheets

METHOD FOR THE PRODUCTION OF HYDROCARBON FUELS WITH ULTRA-LOW SULFUR CONTENT

FIELD OF THE INVENTION

The present invention relates to the field of sulfur removal from hydrocarbon fuels, including diesel oil. In particular, the present invention relates to a new catalytic oxidation/extraction process for the removal of sulfur containing compounds from middle distillates.

BACKGROUND TO THE INVENTION

Hydrocarbon fuels that are presently used to power diesel engines typically comprise 500 ppm of sulfur. In the interests of reducing environmental pollution, there are continuing efforts to generate simpler and more effective methods to reduce the sulfur content of diesel fuels, which may be applied to an industrial scale.

Existing techniques for the removal of sulfur-containing compounds from hydrocarbon fuels have traditionally involved catalytic hydrogenation under pressure. Although such techniques are relatively inexpensive, the concentration of sulfur in the product fuels is typically greater than 500 ppm. Subjecting the fuel to multiple rounds of hydrogenation can achieve lower final sulfur concentrations. However, sulfur-containing compounds that are sterically hindered are not amenable to extraction by such techniques. As a result, even after multiple rounds of hydrogenation, sulfur concentrations of less than 100 ppm are generally unobtainable. Moreover, multiple hydrogenation steps can increase the production costs of the fuels to levels that are not economically viable.

More recently, the development of oxidation techniques has resulted in increased efficiency of sulfur removal from hydrocarbon fuels. Typically, related processes involve two principle steps. In the first step, the sulfur-containing compounds (present in the hydrocarbon fuel) are oxidized for example by oxidants such as peroxy organic acids, catalyzed hydroperoxides, inorganic peroxy acids or peroxy salts. The oxidized compounds generated include sulphoxides or sulphones resulting from oxygen donation to thiol and thiophene groups.

In the second step of the process, the oxidized products (which are more polarized) can be readily extracted from the hydrocarbon fuel using a polar solvent. Typically, the polar solvent may be a lower alcohol such as methanol, which is partially miscible with diesel oil; a property which confers the advantage of ensuring homogeneous distribution of the polar solvent into the hydrocarbon fuel. This ensures maximal exposure of the oxidized compounds to the polar solvent, thus resulting in optimal extraction of sulfur from the fuel. When the mixture is transferred to conditions that induce phase separation, the oxidized sulfur-containing compounds may be drawn off in the methanol phase, leaving behind a hydrocarbon fuel with a reduced sulfur content.

Generally, it is known in the art that the limiting factor governing the efficiency of sulfur removal is the initial oxidation process. The greater percentage of sulfur-containing compounds that are oxidized, the more sulfur may be removed at extraction. For this reason, developments in the field have attempted to improve oxidation efficiency.

For example, U.S. Pat. No. 3,816,301, issued Jun. 11, 1974, teaches a method for the desulfurization of hydrocarbon material involving oxidation of sulfurons compounds via a peroxy-oxidant in the presence of a molybdenum containing catalyst, and at least one saturated alcohol. In this case, the alcohol is preferably tertiary butyl alcohol, which functions to promote sulfur oxidation by reducing the viscosity of the oxidation reaction mass.

U.S. Pat. Nos. 3,945,914 and 3,970,545 issued Mar. 23, 1976 and Jul. 20, 1976 respectively, disclose further improvements to the oxidation/extraction process. U.S. Pat. No. 3,945,914 claims a process involving oxidation of sulfur-containing compounds followed by heating the fuel to a temperature at which the oxidized sulfur-containing compounds are evaporated, and subsequently reacted with a metal, thus separating the sulfur from the hydrocarbon fuel. Preferably, an oxidation catalyst is present, and a tertiary butyl alcohol can be present as a solvent. U.S. Pat. No. 3,970,545 discloses similar methods, wherein prior to oxidation the method further comprises the step of hydrogenating the sulfur-containing hydrocarbon feedstock in a non-catalytic process to form hydrogen sulfide. In the catalytic oxidation step, the catalyst is preferably prepared from molybdenum metal partially dissolved in an alcohol, such as a tertiary butyl alcohol. U.S. Pat. Nos. 3,945,914 and 3,970,545 therefore both disclose the use of alcohol as a solvent for the oxidation catalyst.

Processes involving alternative oxidation conditions have also been developed. For example U.S. Pat. No. 6,160,193, issued Dec. 12, 2000, discloses an oxidation/extraction process, wherein the oxidation process is monitored and stopped before oxidation of hydrocarbon compounds can ensue. The principle improvements of this patent relate specifically to the monitoring of the reaction process to ensure hydrocarbon oxidation does not occur. In preferred features of the invention, the patent teaches that the oxidant may be an acid such as peroxyacetic acid or peroxysulfuric acid. In this way, the liquid phase oxidation does not involve solid catalyst. The patent also teaches that the preferred extraction solvent is dimethylsulfoxide (DMSO), which results in efficient removal of oxidized species. However, it is important to note that the use of DMSO contaminates the hydrocarbon fuel with sulfur. To remove the DMSO from the fuel mixture, multiple water washing steps are required. In summary, U.S. Pat. No. 6,160,193 teaches a long, complex and expensive procedure for sulfur removal from hydrocarbon fuel.

U.S. Pat. No. 6,171,478 discloses a process for desulfurization of a hydrocarbon oil, involving both hydrodesulfurization and oxidation/extraction. The patent teaches that the fuel may be contacted with a hydrodesulfurization catalyst, thus generating hydrogen sulfide and a first hydrocarbonaceous oil stream. Subsequently, the first hydrocarbonaceous oil stream (with reduced sulfur content) is treated with an oxidizing agent (which in one embodiment is aqueous), which is partially decomposed after the oxidation step. The sulfur-oxidated compounds are then separated (using an appropriate solvent as necessary), and the resulting hydrocarbon fuel (with reduced sulfur content) is isolated. In an alternative embodiment, the extraction solvent comprising sulfur-oxidized compounds, may be recycled. Preferred solvents include acetonitrile, dimethyl formamide, and sulpholane, all of which are sources of nitrogen or sulfur. Therefore, these solvents can contaminate the feed stock with additional nitrogenous or sulfurous compounds, and additional purification steps may be needed to ensure complete removal of such compounds from the final fuel product. In summary, U.S. Pat. No. 6,171,478 essentially discloses a combination of processes, which are known in the art, to generate hydrocarbonaceous fuels with reduced sulfur content.

There is a continuing need to generate hydrocarbon fuels comprising ultra-low levels of sulfur content. Importantly, it is desirable that novel methods for sulfur extraction employ a minimal number of steps, to enable facile desulfurization on an industrial scale. It is further desirable to design such desulfurization techniques to utilize non-toxic and inexpensive reagents that are readily amenable to recycling.

It is therefore an object of the present invention to provide a relatively simple method for extracting sulfur-containing compounds from diesel fuels that is applicable for use on an industrial scale. It is further an object of the present invention to provide a process for the efficient oxidation of sulfur compounds present in middle distillates, without the need for acids or other reactive or toxic chemicals (which can contaminate the feed stock). It is a further object of the invention to provide a process for the production of a hydrocarbonaceous fuel with reduced sulfur content, wherein the sulfur-containing compounds are oxidized and extracted using a non-nitrogen and non-sulfur containing solvent, such as methanol. It is a further object of the invention to provide a process for the production of a hydrocarbonaceous fuel comprising less than 50 ppm sulfur.

SUMMARY OF THE INVENTION

The present invention discloses a method for the desulfurization of petroleum middle distillates, in which ethanol is present throughout the catalytic oxidation step. In this way, the oxidation catalyst (typically a metal catalyst) is endowed with a dual role. The oxidation catalyst and $H_2O_2$ can function directly to induce oxidation of sulfur-containing species. In addition, the catalyst and $H_2O_2$ can oxidize a small fraction of ethanol present in the reaction, thus generating the corresponding peracetic acid. In turn, the peracetic acid helps to drive the oxidation of the sulfur-containing compounds by converting thioethers to sulfoxides and sulfones, which remain solublised in the ethanol. Therefore, the presence of ethanol during catalytic oxidation helps to accelerate the oxidation reaction, the ethanol being the precursor of the co-catalyst, peracetic acid. This results in an improved efficiency of sulfur removal upon subsequent extraction with a polar solvent.

The use of ethanol as a catalytic precursor presents additional advantages. Since the ethanol may be partially miscible with diesel oil, homogeneous distribution of the catalytic precursor is achieved throughout the fuel. Moreover, the sulfoxide and sulfone products remain solublized in the alcohol following oxidation. The alcohol containing dissolved sulfoxides and sulfones may form a distinct phase at room temperature, thus permitting a portion of the oxidized compounds to be removed. The remaining alcohol (and remaining sulfoxides and sulfones) may be removed by extraction with a polar solvent, such as methanol.

Optionally, the methods of the present invention may include an additional step of catalytic hydrogenation, to reduce the overall sulfur content of the hydrocarbon fuel, prior to oxidation and extraction.

DETAILED DESCRIPTION OF THE PREFERRED EMBODIMENTS

Figure 1:
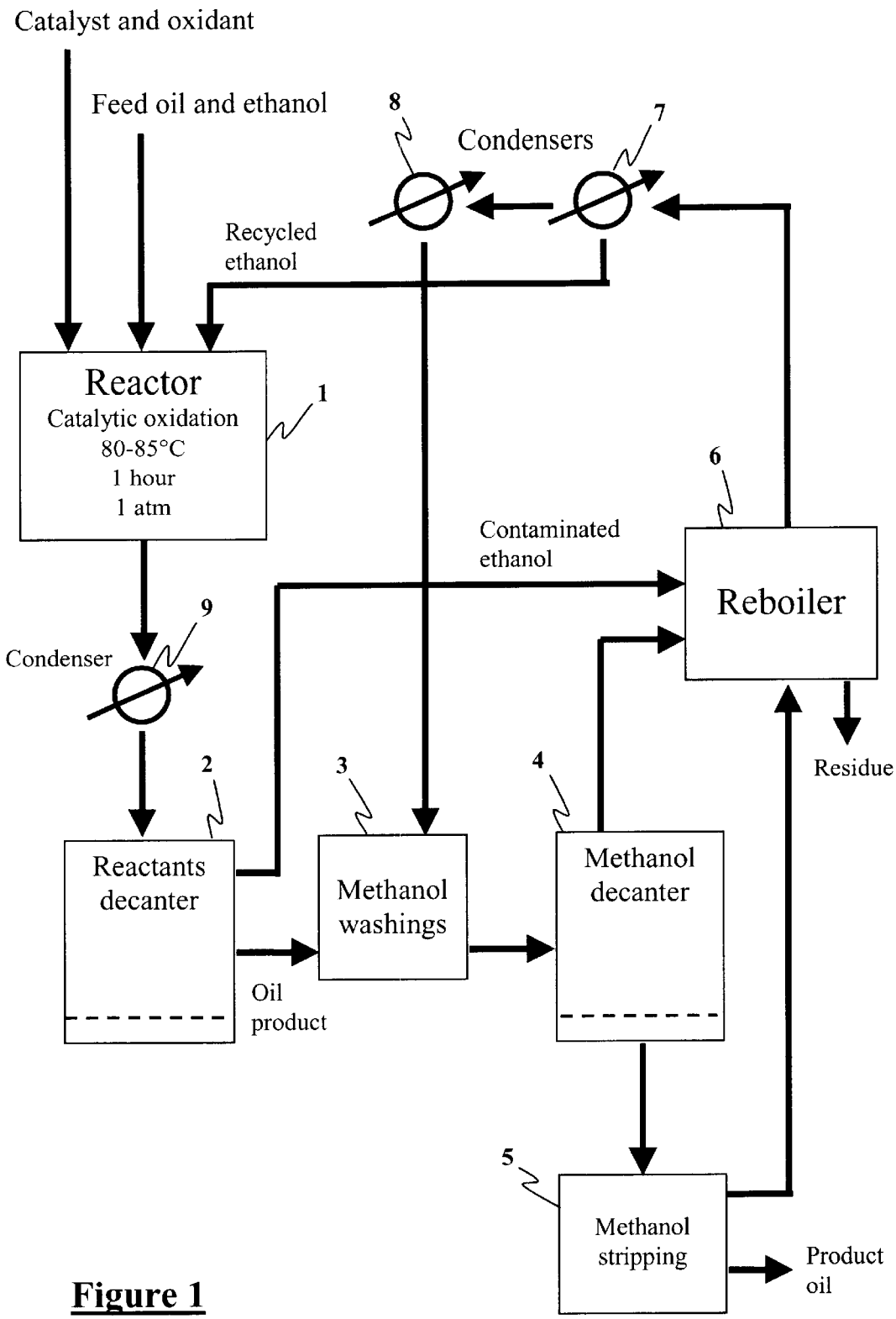
FIG. 1 A schematic representation of an embodiment of the process of the present invention. The embodiment encompasses a continuous flow system involving the recycling of ethanol and methanol.

The methods of the present invention permit the efficient and rapid removal of oxidized sulfur compounds from middle distillates. Specifically, the invention provides for an improved oxidation process for polarizing sulfur-containing compounds that are present in hydrocarbon fuels. In this way, a greater percentage of the sulfur can be extracted from the fuel using a polar solvent.

The present invention teaches the use of ethanol, which is present in the catalytic oxidation step, for accelerating the oxidation process. In this way, the oxidation catalyst converts a small portion of the ethanol to the corresponding peracetic acid, which assists in the oxidation of the sulfurous compounds. Moreover, following the oxidation step of the reaction, the fuel mixture can be transferred to conditions at which partial phase separation of the alcohol occurs. In this way, a portion of the alcohol (containing dissolved oxidized sulphurous compounds) may be drawn off. Ethanol is also a particularly suitable alcohol for several reasons. Firstly, ethanol will readily dissolve the majority of the oxidized (and polarized) sulphurous-compounds present in the fuel. Ethanol is readily miscible with methanol, and therefore the extraction of residual ethanol (containing residual sulfurous compounds) from the fuel mixture can be readily achieved. The anhydrous ethanol is not particularly preferred. Regarding environmental considerations, ethanol encompasses a biodegradable and readily replaceable fuel additive, that is non-corrosive and inexpensive.

According to the present invention, the ethanol is present in the oxidation reaction mixture, which also comprises hydrocarbon fuel, oxidation catalyst and an oxidant. The reaction mixture is generally combined at a temperature of about 40° C. to about 50° C. Then the temperature is increased to reflux at a temperature of from about 60° C. to about 85° C., at atmospheric pressure, for about 30 minutes (generally not more than one hour). For optimal efficiency of the oxidation reaction, at least an equimolar amount of oxidant is required compared to sulfur content. This typically represents a very small amount of concentrated hydrogen peroxide.

Oxidation catalysts that are suitable for use in the processes of the present invention include metal-based catalysts. Preferably, the catalyst comprises vanadium as an inorganic compound or an organo-metallic complex. Also preferred are catalysts comprising vanadium oxide promoted by Tungsten oxide and loaded on $TiO_2$ and then wash coated on synthetic cordierite, $2MgO.2Al_2O_3.5SiO_2$. An advantage of the process of the present invention is that the oxidation catalyst is not consumed, and is preferably recycled for multiple rounds of oxidation.

In the oxidation step, suitable oxidants include, but are not limited to, hydrogen peroxide, ozone, oxygen, or air. A particularly preferred oxidant is hydrogen peroxide.

Following oxidation, the oxidized sulfurous compounds are extracted from the reaction mixture. Methods that are suitable for extraction include fractional distillation, extractive distillation, adsorption, or a combination of these. Typically, polar solvents such as alcohols are used to 'wash' the oxidized sulfurous compounds from the reaction mixture, and for this purpose, methanol is particularly preferred. In this way, a 60–70% reduction in the concentration of sulfur can be achieved after one washing. Methanol diffuses readily into the reaction mixture, to form a homogeneous solution with the residual ethanol (containing residual oxidized sulfurous compounds) dissolved in oil. Subsequent induction of phase separation of the methanol from the reaction mixture draws the residual ethanol (containing oxidized sulfurous compounds) from the hydrocarbon fuel. Ultimately, several washes of the reaction mixture with methanol can result in a hydrocarbon fuel that is substantially free of alcohols and oxidized sulfurous compounds.

In one embodiment of the present invention, the desulfurization process can include the optional, additional step of catalytic hydrogenation. Inclusion of a hydrogenation step prior to the oxidation step permits initial extraction of a significant proportion of the sulfur from the hydrocarbon fuel. The inclusion of a hydrogenation step is particularly advantageous when the initial fuel comprises high levels of sulfur. In this way, hydrogenation can remove a portion of the sulfur in the majority of the contaminant compounds. These compounds include sulfur at positions that are not sterically hindered, and are therefore amenable to direct hydrogenation, thus resulting in the generation of hydrogen sulfide. The resulting oil product (with reduced sulfur content) can then be subjected to oxidation and extraction in accordance with the teachings of the present invention.

With regard to environmental considerations, the present invention teaches a process that involves the use of minimal quantities of reagents, which may be recycled as appropriate for multiple rounds of desulfurization. In particular, the improved efficiency of oxidation achieved by the involvement of ethanol permits a reduction in the quantity of catalyst required to achieve the same oxidation efficiency. Moreover, less solvent is needed for the washing steps since multiple rounds of oxidation can be avoided. Importantly, the ethanol and methanol can be recycled for multiple rounds of oxidation and extraction, as illustrated in the following embodiment.

An embodiment for carrying out the desulfurization methods of the present invention is shown in FIG. 1. This embodiment is applicable for 'continuous flow' separation of sulfur-containing compounds from the hydrocarbon fuel. The catalyst, oxidant, feed oil and ethanol are fed into the reactor for catalytic oxidation (1). Reflux ensues at 80 to 85° C. for 1 hour at atmospheric pressure. The reaction products are fed through a condenser (9), and are partially separated in the reactants decanter (2). The majority of the ethanol (containing oxidized sulfurous compounds dissolved therein) can be drawn off at this stage and fed to a reboiler (6). The oil product left behind in the reactants decanter retains residual ethanol (also containing oxidized sulfurous compounds), which must be extracted from the oil product. This achieved by methanol washings (3). The oil product/methanol mixture is fed to a methanol decanter (4), wherein the oil product (now substantially free of ethanol and sulfurous compounds) may be separated from the methanol. Any residual methanol retained in the product oil that is not extracted at step (4) is removed from the oil product at the step of methanol stripping (5), to generate the final oil product. The methanol removed from the oil product at steps (4) and (5), is fed to the reboiler (6), and combined with the ethanol (containing oxidized sulfurous compounds) from step (2). The resulting ethanol and methanol vapor is drawn off the reboiler (6) and fed into a series of condensers (7 and 8). The ethanol recovered by condenser (7) is recycled back to the reactor for catalytic oxidation (1), and the methanol recovered by condenser (8) is recycled back to the methanol washing step (3). The sulfurous compounds that originate from the feed oil, form a residue following evaporation of the ethanol and methanol in the reboiler (6). This residue may be recovered from the reboiler and disposed of appropriately.

The desulfurization methods of the present invention will now be illustrated with reference to several examples as detailed below.

EXAMPLE 1

A diesel fuel, containing 150 ppm S was mixed with ethanol at a ratio of 2:1 and catalyst 50:1.2. The catalyst was a powder of $W/V/TiO_2$ loaded on cordierite. The resulting mixture was heated at 50° C. and rapidly treated with $H_2O_2$, 30 wt %; oil:$H_2O_2$ ratio=50:1.5. Then the mixture was heated at reflux, 83° C. for 1 h. The mixture was allowed to separate in two phases and the lower phase was washed with MeOH, oil:MeOH=2:1. Removal of methanol left an oil with 37 ppm S. Sulphur was reduced by 75 wt %. The oil was recovered at a yield of 83%. Some oil was lost on catalyst and some on the glassware.

EXAMPLE 2

An oil, diesel type, obtained by thermal cracking of used lubrication oil, containing 1289 ppm S (Oil A) was mixed with MeOH at 2:1 ratio. A soluble V catalyst, $V(AcAc)_3$ was added to the previous mixture to have a concentration of 0.05 wt %. The resulting mixture was heated to 40–50° C. and treated with 1.2% $H_2O_2$ at 30 wt %. The heating was increased to reflux and continued for 1 h. The mixture was allowed to separate into two phases and the lower phase was washed with MeOH, oil:MeOH=2:1. The S in oil was reduced to 820 ppm.

EXAMPLE 3

Middle distillate oil, diesel type, obtained by thermal cracking of used lubrication oil, containing 1289 ppm S (Oil A) was mixed with EtOH at wt. ratio of 2:1. A soluble V catalyst, $V(AcAc)_3$ was added to the previous mixture to a concentration of 0.05 wt %. The resulting mixture was heated to 40–50° C. and treated with 1.2% $H_2O_2$ at 30 wt %. The heating was increased to reflux and continued for 1 h. The mixture was allowed to separate into two phases and the lower phase was washed with EtOH, oil:EtOH=2:1. The S in the washed oil was 580 ppm.

EXAMPLE 4

An oil, diesel type, containing 150 ppm S was mixed with ethanol at a wt. ratio of 2:1. A soluble V catalyst, $V(AcAc)_3$ was added to the previous mixture to have a concentration of 0.05 wt %. The resulting mixture was heated to 40–50° C. and treated with 1.0% $H_2O_2$ at 30 wt %. The heating was increased to reflux and continued for 1 h. The mixture was allowed to separate into two phases and the lower phase was washed with MeOH, oil:MeOH=2:1. The S in the washed oil was 48 ppm.

EXAMPLE 5

A series of experiments was carried out to compare sulfur reduction in fuels of differing sulfur content, using three different catalysts. The results are summarized in Table 1. The results of the experiments described in Examples 2, 3, and 4 are shown in the first three lines Table 1 respectively.

Of particular note, is the success the tungsten/vanadium/titanium dioxide catalyst (supported on cordierite) when used in accordance with the methods of the present invention. The results shown in Table 1 demonstrate that the methods of the present invention permit up to 75% of sulfurous compounds to be extracted from hydrocarbon fuels, in one reaction cycle.

TABLE 1

S reduction with V catalysts

| Experiment Number | Catalyst | S in product ppm | S reduction wt % | Oil yield % |
|---|---|---|---|---|
| 1 | $V(AcAc)_3$ | 800 | 37.9 | 92.1 |
| 2 | $V(AcAc)_3$ | 580 | 55.0 | 73.3 |
| 3 | $V(AcAc)_3$ | 48 | 68.0 | 97.4 |
| 4 | $V(AcAc)_3$ | N/A | N/A | 94.0 |
| 5 | $V(AcAc)_3$ | N/A | N/A | 90.7 |
| 6 | $V(AcAc)_3$ | 672 | 52.0 | 77.1 |
| 7 | $V(AcAc)_3$ | 12 | 52.0 | 96.6 |
| 8[1] | $V(AcAc)_3$ | 840 | 35.0 | 96.0 |
| 9 | $V_2O_5$/AlMCM | 859 | 33.4 | 79.3 |
| 10[2] | $V(AcAc)_3$ | 464 | 64.0 | 76.7 |
| 11[3] | $V(AcAc)_3$ | 642 | 50.2 | 88.4 |
| 12[4] | $V(AcAc)_3$ | 644 | 50.0 | 86.9 |
| 13 | W/V/$TiO_2$/cordierite | 37 | 75.0 | 83.0 |
| 14 | W/V/$TiO_2$/cordierite | 48 | 68.0 | 84.0 |
| 15 | W/V/$TiO_2$/cordierite | 18 | 63.0 | 82.9 |

[1]Low amount of catalyst
[2]3 consecutive reactions; yields 96.3%, 92.2%, 92.7%
[3]3x catalyst and $H_2O_2$
[4]3 h reaction time

EXAMPLE 6

A comparison of the reactants and products for five separate experiments is shown in Table 2.

TABLE 2

| | Reactants[1] | | | | Products[2] | | | | Oil |
|---|---|---|---|---|---|---|---|---|---|
| Experiment Number | Oil type | S ppm | Oil wt % | Alcohol wt % | S ppm | S red. wt % | Oil wt % | Alcohol wt % | Yield % |
| 1 | Oil A[3] | 1289 | 61.5 | 37.2 | 800 | 37.9 | 58.9 | 37.3 | 92.1 |
| 2 | Oil A[4] | 1289 | 65.5 | 32.9 | 580 | 55.0 | 48.6 | 35.4 | 73.3 |
| 3 | Oil B[5] | 1400 | 65.6 | 33.1 | 672 | 52.0 | 50.3 | 36.8 | 77.1 |
| 4 | Low S diesel | 25 | 65.5 | 33.0 | 12 | 52.0 | 63.8 | 34.9 | 96.6 |
| 5 | Low S diesel | 150 | 64.5 | 33.9 | 48 | 68.0 | 63.5 | 35.6 | 97.4 |

[1]Balance is made by catalyst and $H_2O_2$
[2]Balance is made by catalyst, $H_2O_2$ and losses
[3]The alcohol for reaction and extraction was MeOH
[4]The alcohol for reaction and extraction was EtOH
[5]Untreated oil A

EXAMPLE 7

Figure 2:
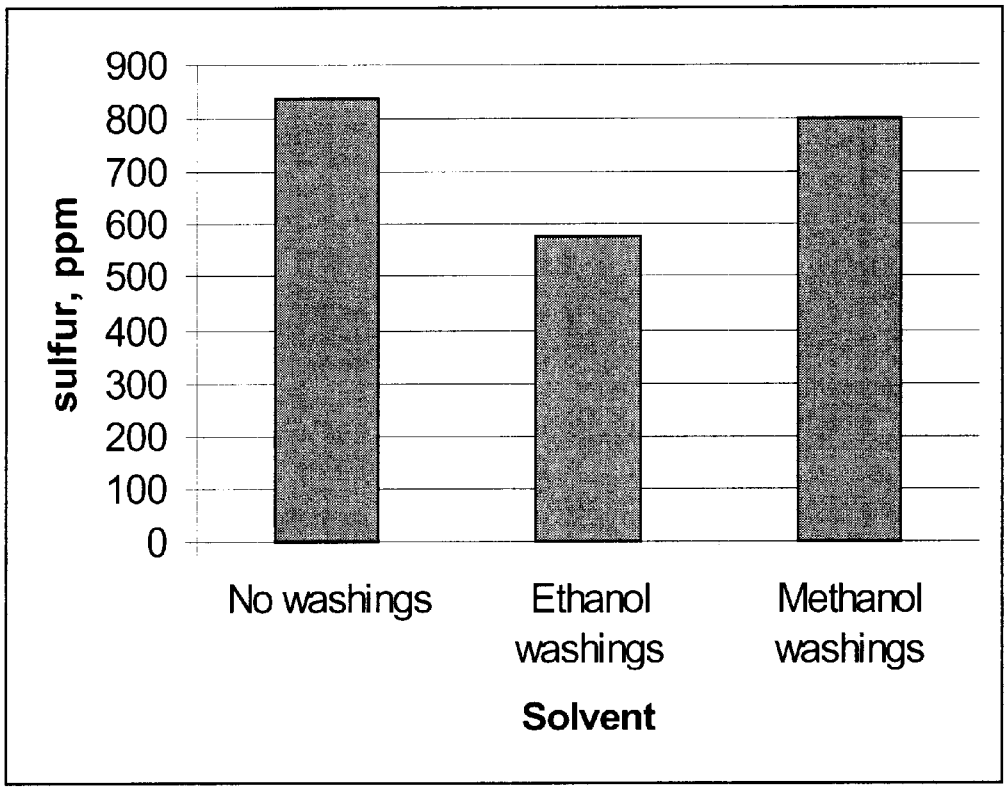
FIG. 2 A graph to compare the ability of methanol and ethanol to extract oxidized sulfurous compounds from a hydrocarbon fuel.

Twice the amount of the same oil used in Example 2 and 3 was mixed with EtOH at wt. ratio of 2:1 and $V(AcAc)_3$ was added to a concentration of 0.05 wt %. The resulting mixture was heated to 40–50° C. and treated with 1.2 wt % $H_2O_2$ at 30 wt %. The heating was increased to reflux and continued for 1 hour. Then, the mixture was allowed to cool to room temperature and separate into two phases. The lower phase (oil phase) was split in two equal amounts. One amount was washed with MeOH, oil:MeOH=2:1 and the other amount with EtOH, at the same ratio, oil:EtOH=2:1. The S contents are shown in the FIG. 2. Bar 3 represents the S content in the oil washed with MeOH, 800 ppm, and the bar 2 represents the S content of the oil washed with EtOH, 580 ppm. Bar 1 is the S content in the oil prior to washing.

EXAMPLE 8

Figure 3:
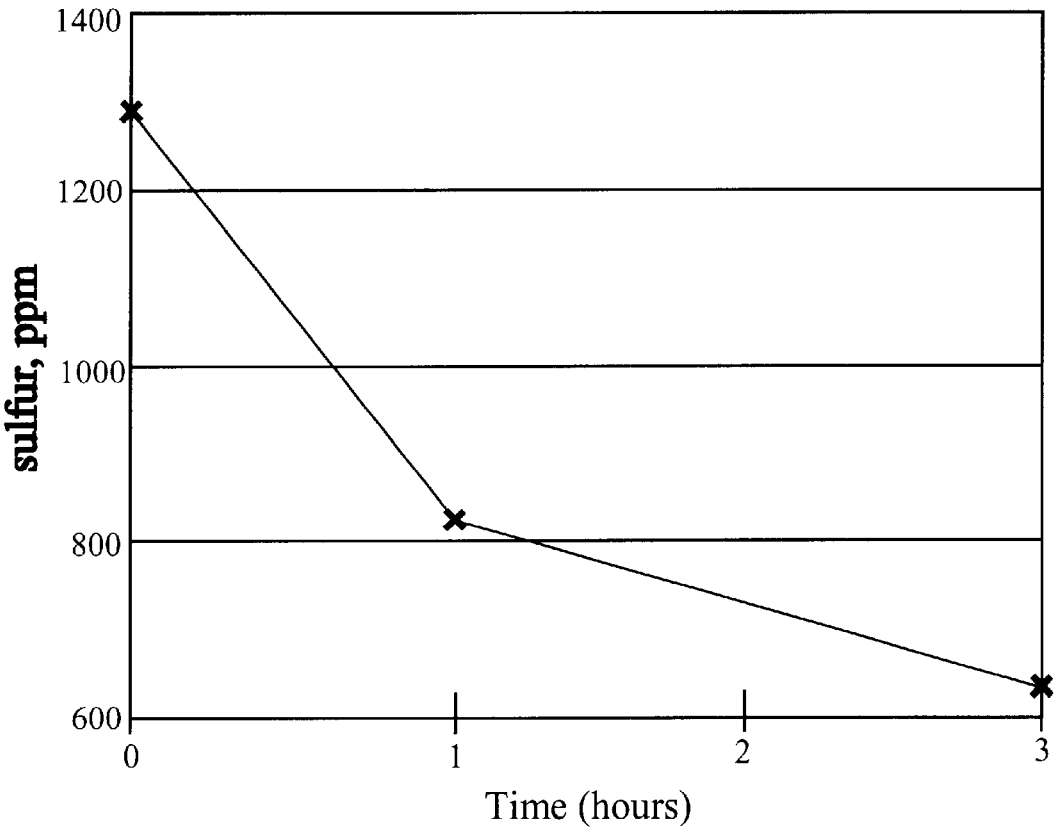
FIG. 3 A graph to show the relationship between oxidation reaction time and sulfur content of the resulting extracted fuel.

An experiment was carried out to determine how oxidation reaction time affected the S removal from oil. A reaction mixture similar to that of Example 3 was reacted at reflux temperature for 3 hours. Then, the mixture was allowed to separate in two phases and the lower phase was washed with MeOH at the same ratio as in Example 3. The results of S analyses are shown in FIG. 3. The graph indicates the longer the reaction time, the higher the S reduction is. However, one hour reaction time appears to be sufficient for the oxidation of S compounds present in oil.

EXAMPLE 9

Figure 4:
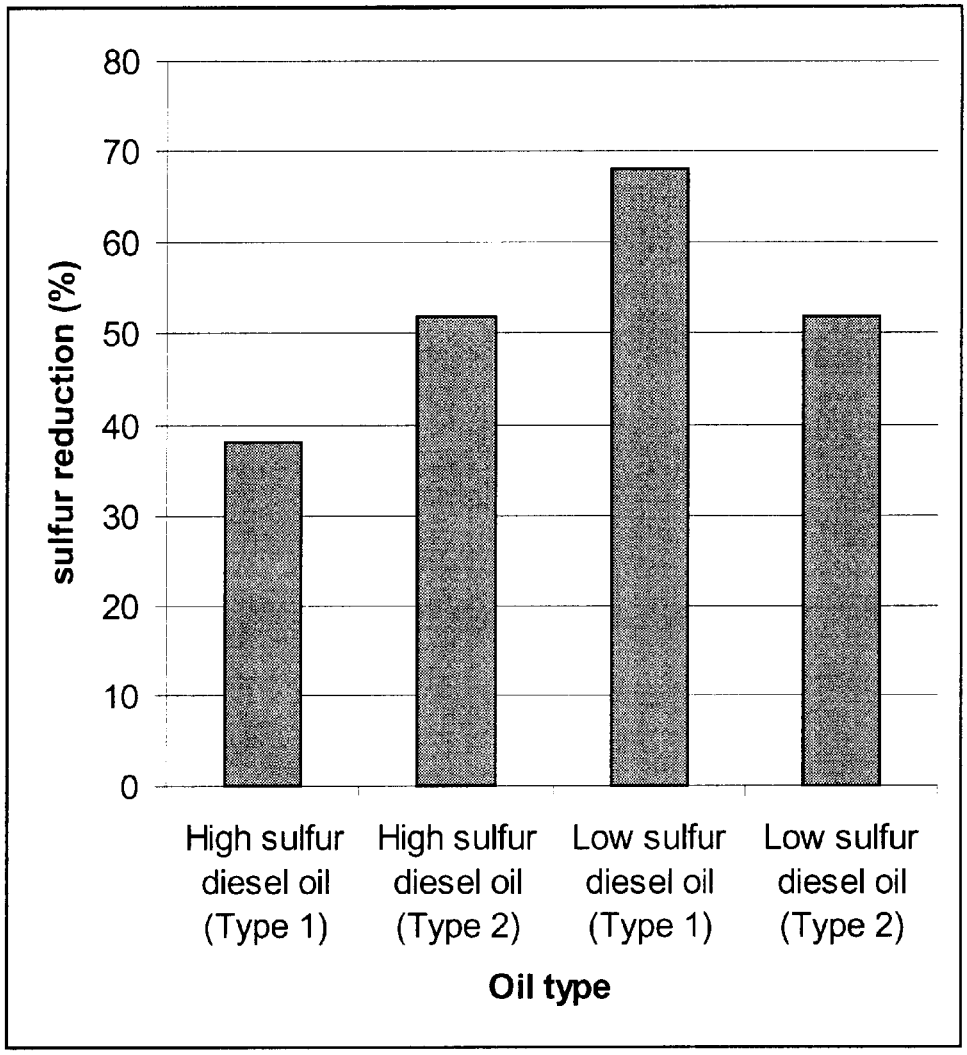
FIG. 4 A graph to compare the efficiency of sulfur removal from diesel fuels comprising high and low levels of sulfurous compounds.

Experiments using same parameters as Example 4 were carried out with different types of hydrocarbon fuels. The efficiency of sulfur removal by the process varied with the type of hydrocarbon fuel (FIG. 4). The results suggest that the desulfurization process of the present invention may work more efficiently upon diesel fuels with a low sulphur content (e.g. fuel with 150 ppm). In this regard, FIG. 4 shows a S removal of 68% of S content of a 'low-sulfur' diesel fuel. However, the S removal from a 'high-sulfur' diesel appears to be lower, from 37.9% to 52% for one stage process.

EXAMPLE 10

The reaction of Example 1 was repeated twice. Removal of methanol left an oil with 18 ppm S. Sulfur was reduced in two stages by 88.8%.

What is claimed is:

1. A process for reducing the sulfur content of a hydrocarbon fuel, comprising the steps of:

(a) contacting a hydrocarbon fuel containing sulfurous compounds with an oxidant and ethanol in the presence of an oxidation catalyst comprising a vanadium compound supported on cordierite to oxidize the sulfurous compounds and to oxidize a portion of the ethanol to form peracetic acid and utilizing the peracetic acid thus formed for further oxidation of the sulfurous compounds; and (b) extracting the oxidized sulfurous compounds with a polar solvent.

2. A process according to claim 1, wherein the oxidation catalyst comprises a vanadium/tungsten/titanium dioxide catalyst supported on cordierite.

3. A process according to claim 2, wherein the oxidant is selected from the group consisting of hydrogen peroxide, oxygen, ozone, or air.

4. A process according to claim 3, wherein the oxidant is hydrogen peroxide.

5. A process according to claim 2, wherein the hydrocarbon fuel comprises middle distillates.

6. A process according to claim 2, wherein the polar solvent is ethanol or methanol.

7. A process according to claim 2, wherein the ethanol and polar solvent are recycled.

8. A process according to claim 2, wherein prior to the oxidation step, the process further comprises the step of:

hydrogenating the sulfurous compounds in the hydrocarbon fuel, using hydrogen and a hydrogenation catalyst.

* * * * *